US009024172B2

(12) United States Patent
Hughes

(10) Patent No.: US 9,024,172 B2
(45) Date of Patent: May 5, 2015

(54) ACOSTICAL OPTICAL PICKUP FOR USE IN A STRINGED MUSICAL INSTRUMENT

(71) Applicant: Kyle Hughes, Redondo Beach, CA (US)

(72) Inventor: Kyle Hughes, Redondo Beach, CA (US)

(73) Assignee: Taff Optical, LLC, Signal Hill, CA (US)

( * ) Notice: Subject to any disclaimer, the term of this patent is extended or adjusted under 35 U.S.C. 154(b) by 206 days.

(21) Appl. No.: 13/694,598

(22) Filed: Dec. 17, 2012

(65) Prior Publication Data

US 2014/0165821 A1 Jun. 19, 2014

(51) Int. Cl.
*G10H 3/06* (2006.01)
*G10H 3/18* (2006.01)

(52) U.S. Cl.
CPC ..... *G10H 3/181* (2013.01); *G10H 3/185* (2013.01); *G10H 2220/471* (2013.01)

(58) Field of Classification Search
CPC ..... G10H 2220/411; G10H 3/06; G10H 2220/305; G10H 3/181; G10H 1/0553; G10H 3/186; G10H 2220/415; G10H 2220/471; G10H 2220/475; G10H 2220/495; G10H 3/22; G10D 3/04; G01H 9/00; G01H 9/004
See application file for complete search history.

(56) References Cited

U.S. PATENT DOCUMENTS 7,977,566 B2 * 7/2011 Haddad ..... 84/724
8,519,252 B2 * 8/2013 Haddad ..... 84/724
8,546,677 B2 * 10/2013 Haddad ..... 84/724
8,772,619 B2 * 7/2014 Haddad ..... 84/724
2009/0260501 A1 * 10/2009 Kashyap ..... 84/297 S
2011/0061517 A1 * 3/2011 Haddad ..... 84/724
2011/0265635 A1 * 11/2011 Haddad ..... 84/724
2012/0234161 A1 * 9/2012 Haddad ..... 84/724
2012/0266740 A1 * 10/2012 Hilbish et al. ..... 84/645
2013/0112069 A1 * 5/2013 Weinreich et al. ..... 84/731

* cited by examiner

*Primary Examiner* — Marlon Fletcher
(74) *Attorney, Agent, or Firm* — Irving Keschner

(57) ABSTRACT

An acoustic instrument is fitted with a flexible member that is fitted into the instrument and attached to the bridge of the instrument in such a fashion that the member vibrates freely in sync with the instrument. A compact optical pickup unit is attached to the flexible member in an arrangement comprised of cooperating optoelectronic devices which are mechanically isolated from the vibrations of the instrument and are positioned on the member. The member interferes with, and when stationary entirely obstructs, the path of a light beam generated by a light emitting device (LED) which is directed towards a light receiving device, the frequency and intensity of the vibrations of the member modulating the frequency and intensity of the light from the LED impinging on the receiving device. The result is an electronic output signal that corresponds to both the frequency of the note (or notes) played and to the tonal quality of the acoustic instrument on which the pickup is mounted. Circuitry associated with the receiving optoelectronic device is biased so that the output produces a signal which can be connected to any industry standard instrument amplifier or sound mixing board.

7 Claims, 4 Drawing Sheets

ACOSTICAL OPTICAL PICKUP FOR USE IN A STRINGED MUSICAL INSTRUMENT

BACKGROUND OF THE INVENTION

1. Field of the Invention

The present invention provides an optical electro acoustic transducer for use in any acoustic string instrument, such as guitars, violins, string bass, cello, etc.

2. Description of the Prior Art

An acoustic guitar, one example of an acoustic string instrument, is a guitar that uses only an acoustic sound board. The air in this cavity resonates with the vibration modes of the string and at low frequencies, the volume of the sound generated increases or decreases depending on whether the air in the box is moving in phase or out of phase with the strings. The resonance interactions attenuate or amplify the sound at different frequencies, boosting or damping various harmonic tones.

No amplification actually occurs in this process, in the sense that no energy is externally added to increase the loudness of the sound (as would be the case with an electronic amplifier). All the energy is provided by the plucking of the string, the function of the entire acoustic system being to maximize intensity of sound.

An acoustic guitar can be amplified by using various types of pickups or microphones. The most common type of pickups used for acoustic guitar amplification are piezo and magnetic pickups. Piezo pickups are generally mounted under the bridge saddle of the acoustic guitar and can be plugged into a mixer or amplifier. Magnetic pickups are generally mounted in the sound hole of the acoustic guitar and are very similar to those found in electric guitars. An acoustic guitar with pickups for electrical amplification is known as an acoustic-electric guitar. New types of pickups have been introduced to try to amplify the full sound of these instruments, such as systems that include an internal microphone along with the body sensors or under the saddle pickups.

Most stringed instruments produce their sound through the application of energy to the strings, which sets them into vibratory motion. The strings alone, however, produce only a faint sound because they displace only a small volume of air as they vibrate. Consequently, the sound of the strings alone requires impedance matching to the surrounding air by transmitting their vibrations to a larger surface area capable of displacing larger volumes of air (and thus producing louder sounds). This calls for an arrangement that allows for the strings to vibrate freely, but also conducts those vibrations efficiently to the larger surface. A bridge is the customary means by which this is accomplished (a bridge is a device that supports the strings on a stringed instrument and transmits the vibration of those strings to some other structural component of the instrument in order to transfer the sound to the surrounding air).

Magnetic soundhole pickups exemplify the same functions as that of electric guitar pickups. Basically, they sense the movement of the strings of plain acoustic or acoustic electric guitars through a magnetic field.

Microphones are accurate transducers used to amplify both plain acoustic and acoustic electric guitars. They convert the sound produced by the guitar into electrical signals that are then picked up by amplifiers. In contrast with the magnetic soundhole pickups, microphones are more prone to feedback; as such, it is important that they are placed closely to the guitar, and that performers whose guitars have these transducers should have constrained motions. Despite the drawbacks of microphones, many musicians still prefer using these transducers because of their ability to pick up certain guitar sound characteristics such as high frequency and percussive sounds produced by tapping that cannot be picked up by other transducers.

Contact pickups are in direct contact with some specific parts of acoustic guitars. They pick up the motions taking place in the locations where they are installed and convert them into electrical signals that are then picked up by amplifiers. Almost all contact pickups use piezoelectric technology. Notable pickups that fall under this classification include the piezos, top pickups, and under-saddle pickups.

What is desired is to provide an acoustical transducer, or pickup, that has a more accurate reproduction to tonal quality of the instrument than provided by current piezo and magnetic pickups and more resistant to feedback than provided by microphones.

SUMMARY OF THE INVENTION

The present invention relates to a transducer device for use with any acoustic string instrument, the transducer device providing a more accurate reproduction to tonal quality to the instrument when compared to existing piezo and magnetic pickups and wherein feedback is significantly reduced when compared to microphone transducers. The acoustic instrument is fitted with a type of reed member that is positioned in the instrument either between the bridge and the body of the instrument or inside the body in such a fashion that the reed can vibrate freely in sync with the instrument. The instrument is also provided with a compact pickup unit attached thereunto in an arrangement comprised of cooperating optoelectronic devices including a LED and phototransistor which are mechanically isolated from the vibrations of the instrument and are positioned adjacent to the reed member. The reed interferes with, and when stationary, entirely obstructs, the path of a light beam generated by a light emitting device (LED) toward a light receiving device. In first embodiment of the invention, the frequency and intensity of the vibrations of the reed modulates the frequency and intensity of the light from the LED impinging on the receiving device to produce an electronic signal that corresponds to both the frequency of the note (or notes) played and to the tonal quality of the acoustic instrument on which the pickup is mounted. The associated circuitry of the receiving optoelectronic device is biased so that the output signal can be connected to any industry standard instrument amplifier or sound mixing board. The device of the present invention requires that the reed and at least one of the optoelectronic devices to be mechanically isolated from each other so that the reed modulates with the vibrations of the instrument and not by external vibrational forces.

In a second embodiment of the invention, the reed is stationary while a housing that encloses the LED and phototransistor is mounted to a flexure member, vibrations from the strings causing the flexure member to move in a manner so that at least a portion of the light beam generated by the LED is incident on the phototransistor. The level of impinging light is determined by the vibrations generated by the plucked strings.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

The present invention provides a system for converting the string vibrations from a musical instrument to a modulated electrical signal, the electrical signal being coupled to an amplifying device to provide an amplified sound that significantly improves tonal characteristics. Two embodiments of the system are described, the first for instruments having a bridge member and the second for instruments without a bridge member.

First Embodiment

Figure 1A:
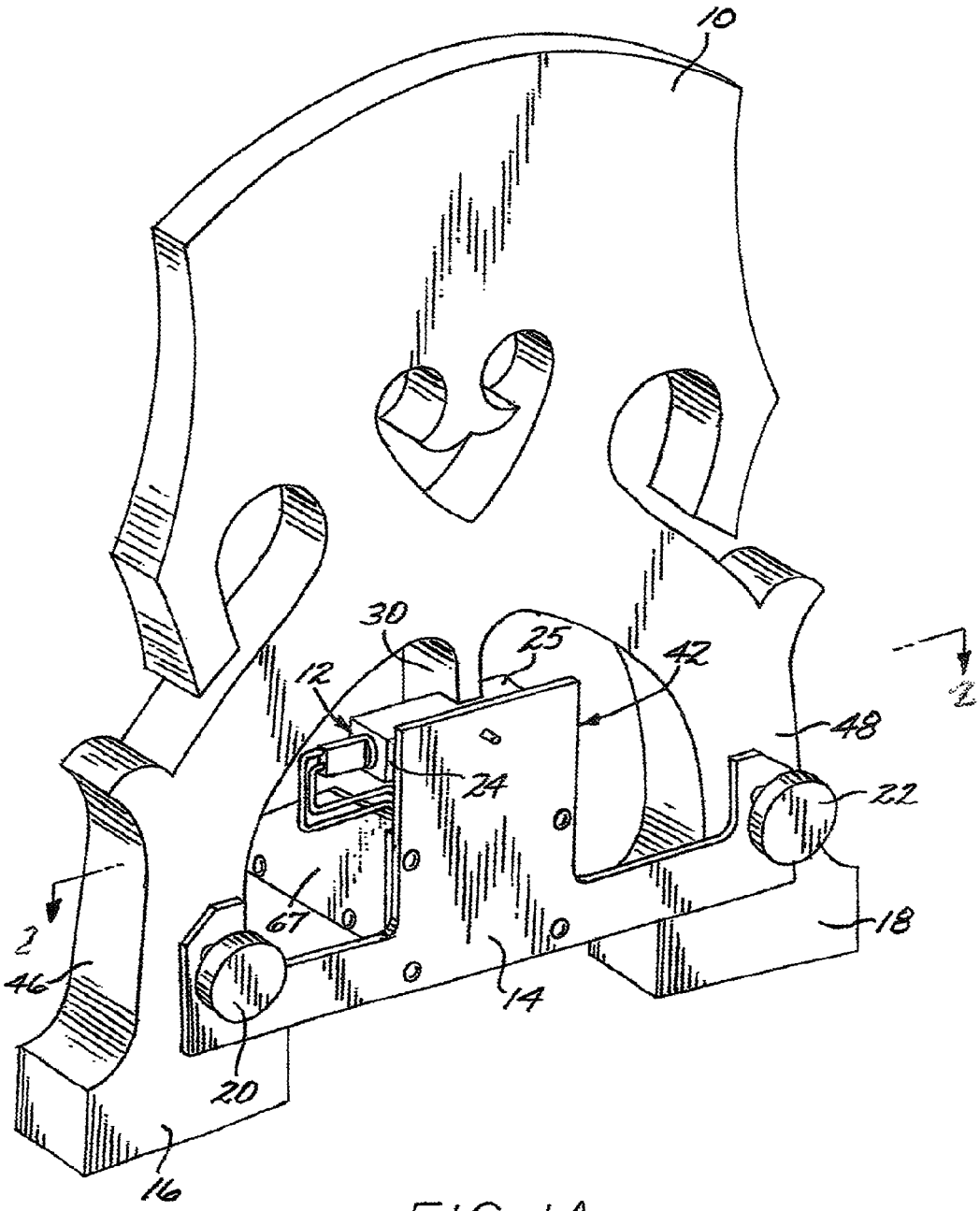
FIGS. 1A and 1B are perspective views of the optical pickup of the present invention utilized with a stringed instrument in accordance with the first embodiment of the present invention utilized with an acoustical instrument having a bridge.
Figure 1B:
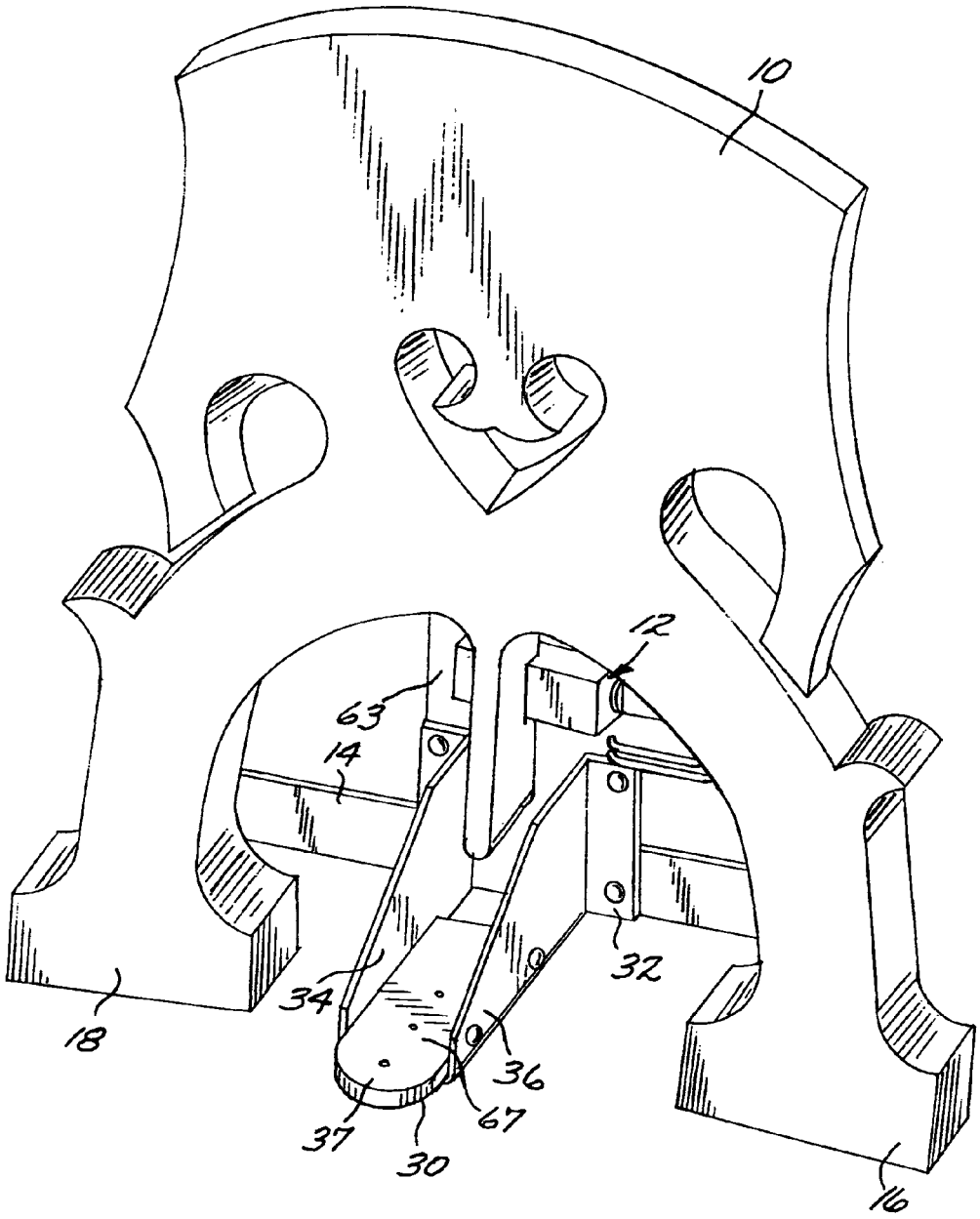

Referring to FIGS. 1A and 1B, a typical stringed instrument bridge member 10 having optical housing 12 of the present invention secured thereto is illustrated. A flexible metal plate, or reed, 14 is attached to legs 16 and 18 of bridge 10 by thumbscrews 20 and 22, respectively. Optical housing 12 is mounted to plate 14, housing 12 containing light emitting diode (LED) 24 and phototransistor 25. A circuit board 23 (FIG. 2) is also mounted to plate 14. Plate 14 functions as a flexure device that is responsive to vibrations generated by a user plucking the instrument strings causing the light emitted by LED 24 to be periodically interrupted. In particular, flexure plate 14 causes optical housing 12 to move to an extent proportional to the strength of the vibrations generated by plucking the instrument stings. The interrupted light causes phototransistor 25 to generate a modulated analog sine wave signal which corresponds to the strength of the vibrations generated by the strings. Reed, or occluder 30, is designed to act as a null point and does not vibrate in relation to optical housing 12. A plate member 32, mounted to and extending from, plate 14 and having legs 34 and 36 is secured to metal flexure plate 14 and extends to the face of the instrument such that the vibrations at the instrument face are transferred through member 37 and plate 32 causing optical housing 12 to move. Foot 37 has a screw 41 (FIG. 2) at its end that adjusts the tension to optimize the transfer of vibrations to the optical housing 12. Note that the system is calibrated such that flexure plate 14 does not move when a user is not plucking the instrument strings and, as a result, the optical housing 12 does not move relative to reed 30, blocking the light generated by LED 24 from impinging upon phototransistor 25. The movement of optical housing 12 is designed so that the LED generated light beam is wholly or partially incident on phototransistor 25 in accordance with the strength of the string vibrations.

Figure 2:
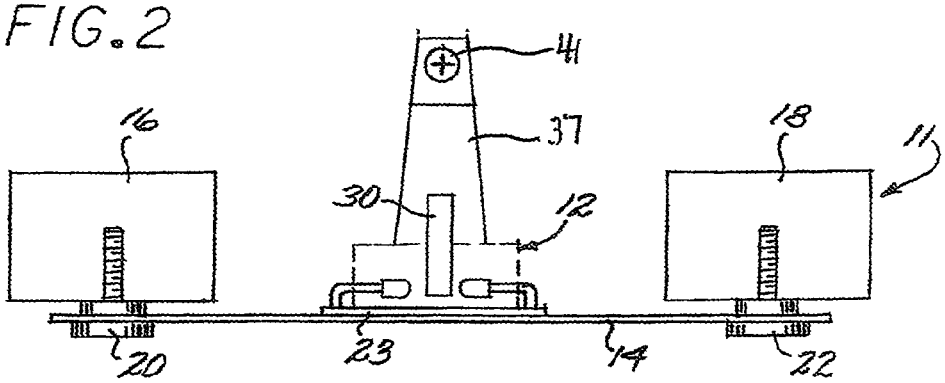
FIG. 2 is a simplified sectional view along line 2-2 of FIG. 1B.

FIG. 2 is a simplified sectional view along line 2-2 of FIG. 1A illustrating the various components of the optical pickup of the present invention. In particular, leg, or foot, 37 is coupled to the face of instrument 10 via thumbscrew 41. Thumbscrew 41 is adjustable in order to control the tension on plate member 32. Thumbscrews 20 and 22 mount the pickup to instrument 10 via bridge member 10 and allows flexure plate 44 and optical housing 12 to move so that the optical portion of the system can be calibrated.

Figure 3:
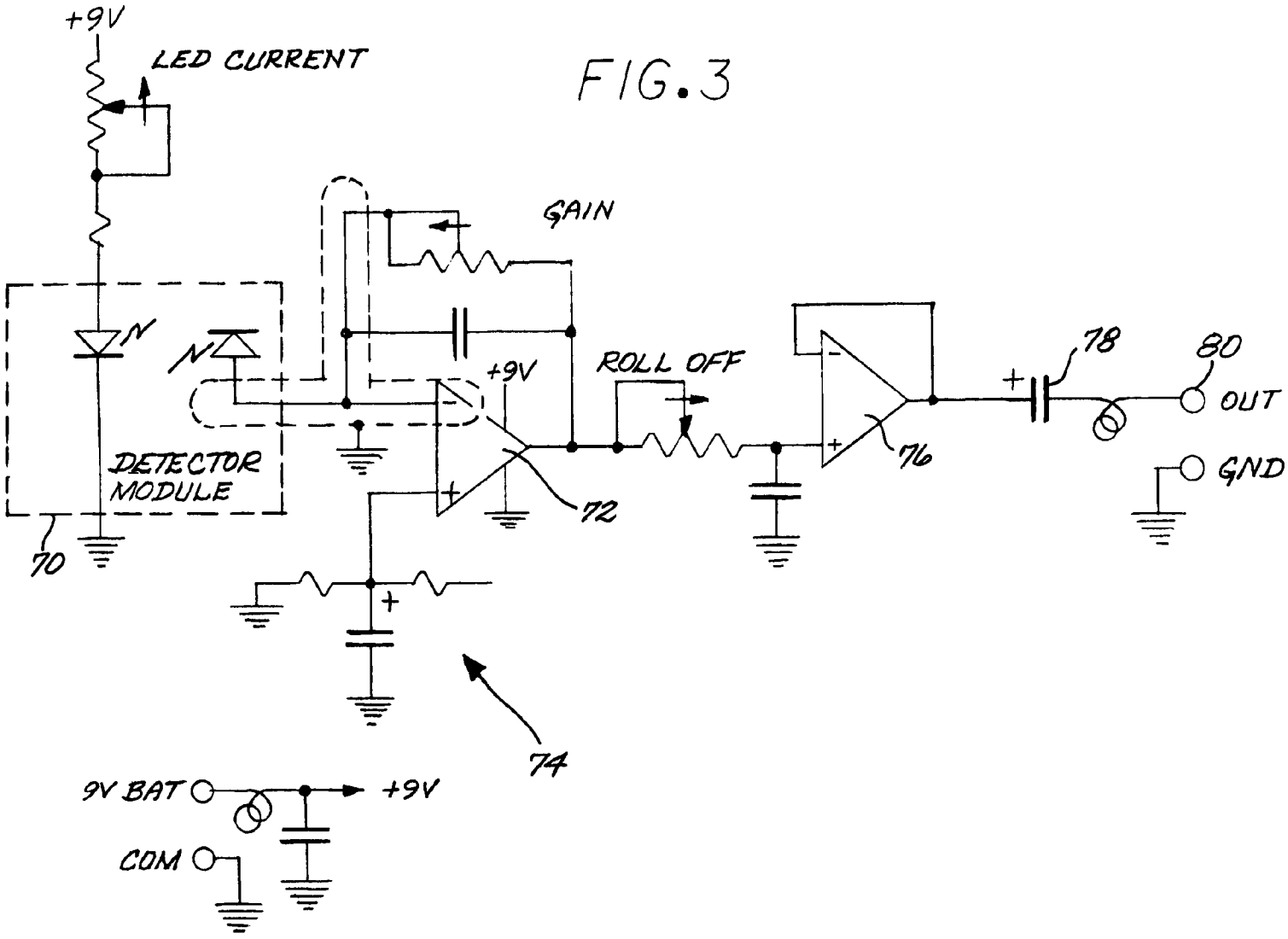
FIG. 3 is an electrical schematic of a circuit board used in the acoustical optical pickup of the present invention.

FIG. 3 is a schematic of the detector electronics utilized in the pickup of the present invention. In particular, the optical signal generated by LED 24 is detected by module 70, module 70 as a result generating a current which is coupled to the negative input of comparator 72. The current magnitude is compared with the magnitude of the current generated by voltage divider 74 coupled to the positive input of comparator 72. When the current differential at the input terminals of comparator 72 is greater than a predetermined amount, an alternating analog signal is generated at the input of amplifier 76. The output signal from amplifier 76 in turn is rectified by capacitor 78. The voltage signal appearing at output terminal 80 is in the shape of a sine wave, whose variable amplitude represents the strength of the vibrations produced by the plucking of the instrument strings by a user.

A LED which has been successfully utilized is the Honeywell 800 nm device, model number SEP8705-002; a phototransistor successfully utilized is the Fairchild 880 nm peak device, model number QSD2030.

Embodiment 2

Figure 4:
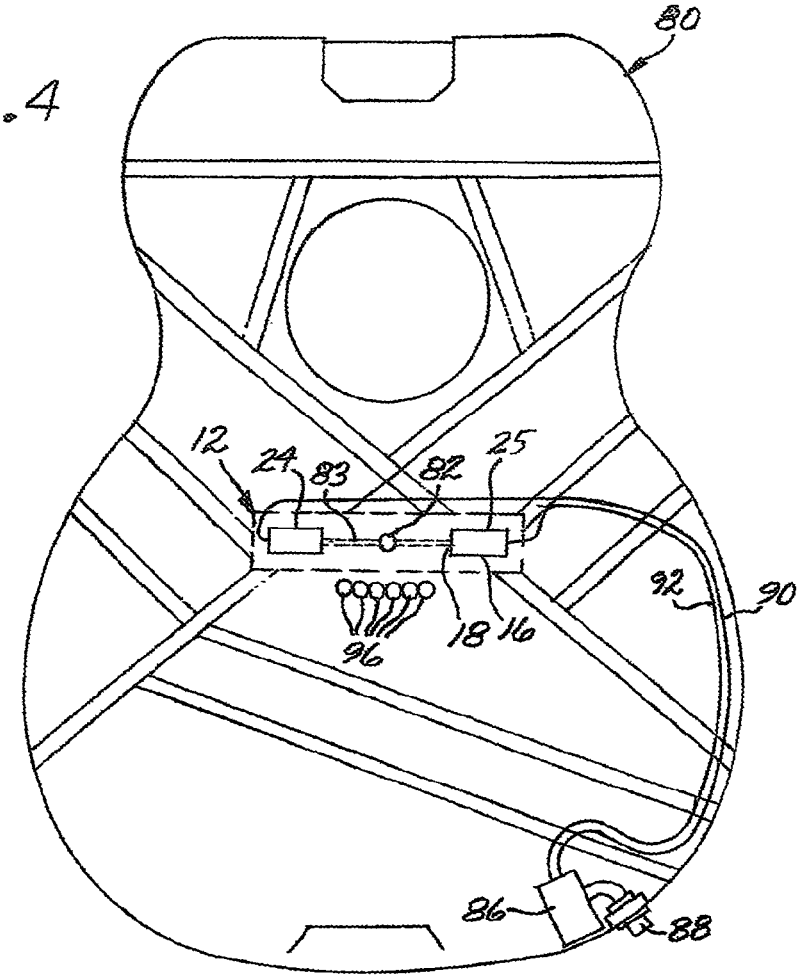
FIG. 4 is a simplified front view of a second embodiment of the optical pickup of the present invention utilized with a non-bridge acoustical instrument.

FIG. 4 illustrates the second embodiment of the present invention wherein an acoustical instrument without a bridge, such as acoustical guitar 80, is adapted to utilize the basic concept of the present invention (FIG. 4 is a frontal, and partial cross-sectional view of guitar 80). Note that the same reference numeral in both embodiments identify identical components.

Optical housing 12 contains LED 24 (preferably an infrared LED although other light sources can be used) and phototransistor 25 is mounted to the interior of instrument 80. Phototransistor 25 is aligned with LED 24 such that the light beam generated by LED 24 is normally incident on the receptor surface of phototransistor 25. A flexible member, or reed, 82 is mounted to guitar 80 in a manner such that it can respond to the movement of the guitar strings (not shown) and positioned to intercept and block the light output 83 generated by LED 24 when the strings have not been plucked by a user. When plucked, the strings cause member 82 to vibrate such that the light output 83 from LED 24 incident on phototransistor 25 interrupted. In essence, member 82 is biased to allow light beam 83 to strike phototransistor 25 such that a sine wave voltage signal is generated having a frequency and amplitude that corresponds to the acoustical sound generated when the guitar strings are plucked.

A 9 volt battery pack and circuit housing 86 is mounted to the interior of the instrument 80 and connected to LED 24 and phototransistor 25 via leads 90 and 92, respectively. The output signal from phototransistor 25 is connected to output jack 88 via lead 90.

The output signal from phototransistor 25 is a sine wave which is typically biased about 1 volt and having a maximum amplitude of 2 volts and a minimum value of zero volts.

The output from jack 88 is coupled to a conventional acoustic amplifier (not shown).

Member 82 is preferably fabricated from wood or other light weight material and can take various shapes, such as an elongated strip or a sphere. Member 82 must be capable of flexing and/or moving such that it can be positioned to allow beam 83 to strike photo transistor 25 when the strings are plucked by a user.

Note that the circular items 96 represent posts that support the guitar strings.

In operation, the instrument player engages a power on switch, not shown, to energize LED 24 and photo transistor 25 via the battery pack 86. As a player plucks the instrument strings, member 82 is caused to vibrate, allowing light beam 83 to be incident upon phototransistor 24 in a manner to produce a sine wave output. The frequency and amplitude of the sine wave depends upon the vibrations generated as the strings are being plucked, causing the output amplifier, in turn, to generate a sound which is proportional thereto.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A pickup device for stringed instrument having strings and a bridge member which vibrates comprising:

a flexible plate;

a source for generating a light beam mounted to said plate;

a device spaced from said source and positioned to receive said light beam, an electrical signal being generated in response thereto, said device mounted to said plate;

said flexible plate being capable of movement when said strings are plucked by a user; said flexible plate being positioned to block said light beam when the strings are not being plucked and moving in a manner to enable the light beam to be received when the strings are plucked thus causing the amplitude and frequency of said signal to vary in accordance with the characteristics of the vibrating instrument strings; and means for amplifying said electrical signal.

2. The device of claim 1 wherein a jack is mounted to said instrument to receive the output from said receiving device.

3. The device of claim 2 wherein said amplifying means is coupled to said jack.

4. The device of claim 1 wherein said light beam source comprises a LED.

5. The device of claim 4 wherein said receiving device comprises a phototransistor.

6. The device of claim 1 wherein said pickup device is mounted to said bridge member.

7. An acoustical optical pickup device for a stringed instrument having an interior portion comprising:

a source for generating a light beam positioned in said instrument interior;

a device spaced from said source and positioned to receive said light beam;

a reed member interposed between said light beam source and receiving device and generating a variable electrical signal having an amplitude and frequency in response thereto, said reed member being movable when the strings of said instrument are plucked by a user thereby causing the amplitude and frequency of said signal to vary in accordance with characteristics of the vibrating instrument strings; and means for amplifying said variable electrical signal.

* * * * *